United States Patent [19]

Bodine

[11] 4,342,364

[45] Aug. 3, 1982

[54] APPARATUS AND METHOD FOR COUPLING SONIC ENERGY TO THE BORE HOLE WALL OF AN OIL WELL TO FACILITATE OIL PRODUCTION

[76] Inventor: Albert G. Bodine, 7877 Woodley Ave., Van Nuys, Calif. 91406

[21] Appl. No.: 139,403

[22] Filed: Apr. 11, 1980

[51] Int. Cl.[3] ..... E21B 43/00; F04B 7/00

[52] U.S. Cl. ..... 166/249; 417/241; 166/104; 166/177

[58] Field of Search ..... 417/240, 241, 53; 166/249, 177, 104

[56] References Cited

U.S. PATENT DOCUMENTS

| | | | |
|---|---|---|---|
| 2,221,775 | 11/1940 | Boynton | 166/177 X |
| 2,702,559 | 2/1955 | Bodine | 417/241 X |
| 2,785,757 | 3/1957 | Middleton | 166/177 |
| 2,999,540 | 9/1961 | Bodine | 166/249 X |
| 3,303,782 | 2/1967 | Bodine | 417/53 |

FOREIGN PATENT DOCUMENTS

| | | | |
|---|---|---|---|
| 717292 | 2/1980 | U.S.S.R. | 166/249 |

*Primary Examiner*—Richard E. Gluck

*Attorney, Agent, or Firm*—Edward A. Sokolski

[57] ABSTRACT

A sonic pump for pumping oil out of an oil well is installed in a tubing string placed in an oil well casing. Sonic energy is coupled to the tubing string from an orbiting mass oscillator installed thereabove so as to cause vibration thereof at a sonic frequency which is preferably such as to cause resonant standing wave vibration of the string. Check valves are installed in the tubing string and are driven by the sonic energy to effect pumping action. The sonic energy generated in the tubing string is effectively coupled to the wall of the bore hole by means of a plurality of annular pistons installed at spaced positions between the string and the casing. An annulus of liquid is maintained in annular spaces formed between successive pistons, between the inner wall of the casing and the outer wall of the string, the sonic energy in the tubing string driving the pistons so as to develop hydraulic pressure pulses in the liquid. Perforations are formed in the casing wall such that the hydraulic pressure pulses are applied through these perforations to the bore hole wall to aid in the extraction of oil therefrom.

8 Claims, 2 Drawing Figures

APPARATUS AND METHOD FOR COUPLING SONIC ENERGY TO THE BORE HOLE WALL OF AN OIL WELL TO FACILITATE OIL PRODUCTION

This invention relates to an apparatus and method for employing sonic energy in the extraction of oil from a well, and more particularly to such an apparatus and method wherein sonic energy is transferred by means of hydraulic pressure pulses to the wall of the bore hole of the well to facilitate the extraction of oil therefrom.

In my U.S. Pat. Nos. 3,303,782 and 2,702,559, techniques for using sonic energy in conjunction with check valves installed along a tubing string are described for pumping oil from an oil well. As emphasized in my U.S. Pat. No. 3,303,782, particularly high pumping efficiency can be achieved when the tubing string is driven at a resonant frequency. In the apparatus described in both of my aforementioned patents, an orbiting mass oscillator employing a pair of eccentric rotors is employed for generating the sonic energy which is coupled to the tubing string.

The present invention is an improvement over the apparatus and techniques described in my aforementioned prior patents in that it enables utilization of the sonic energy generated in the tubing string for stimulating the release of oil from the oil bearing earthen material around the bore hole wall, thereby increasing the production of oil.

This end result is achieved in my invention by mounting a plurality of resilient piston members along the tubing string at spaced positions therealong. The outer walls of these piston members are closely spaced to the inner walls of the casing. A liquid annulus is formed in the annular space between successive pistons. Perforations are formed in the wall of the casing opposite each of the pistons. The vibratory energy generated in the tubing string is transferred to the pistons which operate to develop hydraulic pressure pulses in the liquid annuli between the pistons. These hydraulic pressure pulses pass through the perforations in the casing and are applied to the bore hole wall generating heat therein and vibration of the earthen particles to stimulate the release of oil therefrom.

It is therefore an object of this invention to improve the production of oil in a sonic pumping system.

It is a further object of this invention to provide means for generating hydraulic pulses against the side of the bore hole of a well to stimulate the release of oil therefrom.

Figure 1:
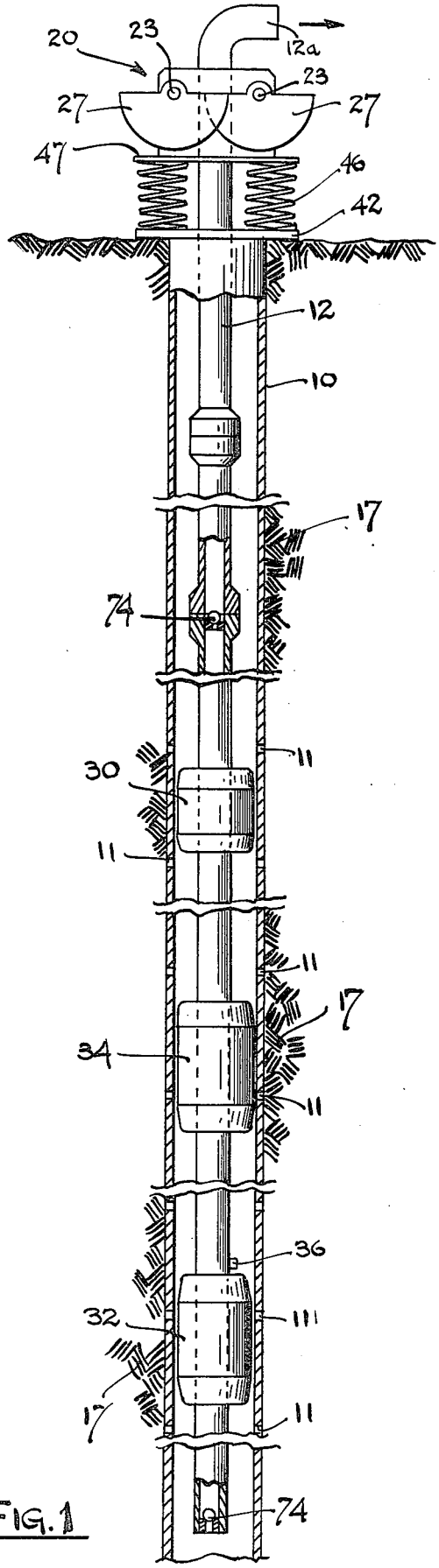
Figure 2:
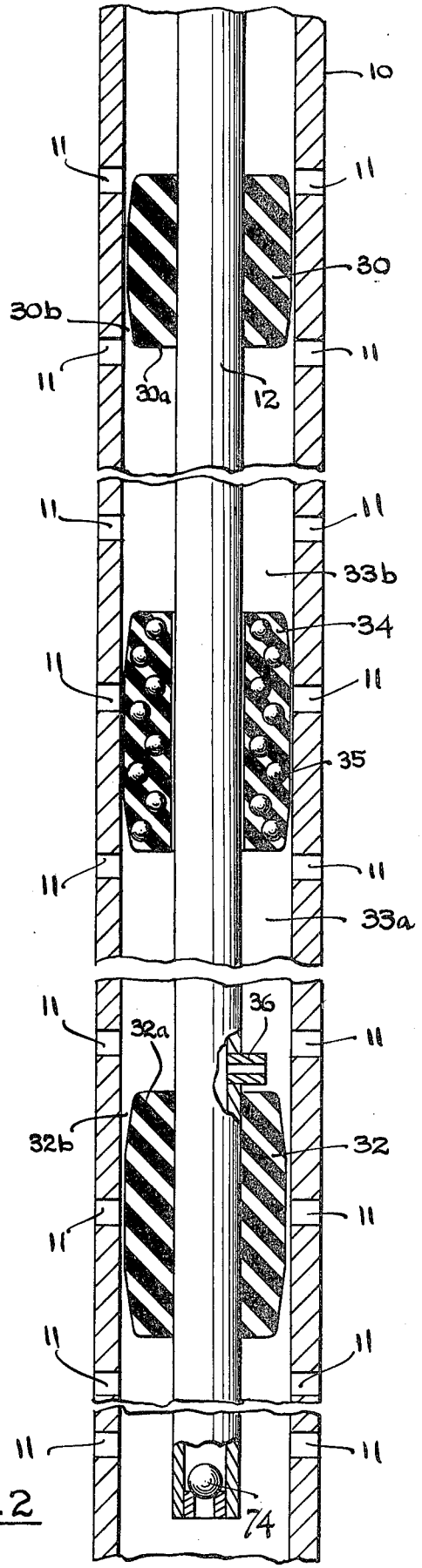

Other objects of the invention will become apparent as the description proceeds in connection with the accompanying drawings of which:

FIG. 1 is an elevational view in cross section of a preferred embodiment of the invention; and FIG. 2 is an enlarged elevational view in cross section illustrating the details of the piston and related structure of the preferred embodiment.

Referring now to the figures, well casing 10 is driven into oil bearing earthen formation 17. Supported on the surface of the ground above casing 10 is a flange plate 42. Vibrational oscillator 20 has a pair of semicircular rotor members 27 which are rotatably supported on shafts 23 which in turn are fixedly supported on plate 47. Plate 47 is supported on ground support plate 42 by means of spring mount 46 to provide vibrational isolation between vibrational oscillator 20 and the ground support plate. Oscillator 20 is connected to tubing string 12 by a suitable coupler (not shown), the string being suspended within casing 10. A fluid outlet 12*a* is formed at the top end of the tubing string. Installed within tubing string 12 at spaced intervals therealong are a plurality of ball check valves 74. Rotors 27 are rotatably driven in opposite directions such that they set up vibration of the tubing string in a longitudinal vibration mode. The frequency of vibration is preferably adjusted so as to effect longitudinal resonant vibration of the tubing string at which frequency maximum amplitude of vibration is achieved.

The device as described thus far is essentially the same as that described in my U.S. Pat. Nos. 2,702,559 and 3,303,782, referred to above. As described in said patents, the vibrational energy generated by means of oscillator 20 is transferred to tubing string 12 and effects pumping action in the string via check valves 74, thus bringing oil from the bottom of the well to the surface and out through outlet 12*a*.

The novel features of the present invention are involved with annular piston members 30, 32 and 34 which are installed at spaced intervals along tubing string 12. The pistons may be spaced from each other a distance of 5–30 feet and may be made of a resilient material, such as a suitable rubber or plastic. Typically, piston 30 may be 5″ in height, while pistons 32 and 34 are 12″ high. Annular pistons 30 and 32 are tightly force fitted on tubing string 12 while piston 34 is a "floating" piston which is closely but loosely fitted on the tubing string. The outer walls of all of the pistons are closely spaced to the inner walls of casing 10, but not tightly fitted thereagainst. An orifice nozzle 36 above piston 32 bleeds some of the pumped liquid from tubing string 12 into the annuli 33*a* and 33*b* formed between the pistons and the casing to maintain liquid in these annuluses as against any outflow leakage past the pistons or through the casing perforations 11. Piston 34 floats on liquid annulus 33*a* and may have lead weighting elements 35 embedded therein to add weight or inertia to the piston.

In operation, the tubing string is vibrated in a longitudinal vibration mode by virtue of the vibratory energy generated by oscillator 20. This energy is transferred to pistons 30 and 32 which are tightly clamped to the tubing string, the liquid contacting surfaces 30*a* and 32*a* of these pistons normally vibrating in 180° phase opposition to each other. Strong pressure pulses are developed in the liquid annuluses 33*a* and 33*b* formed between piston 32 and piston 34 and piston 34 and piston 30, respectively. These liquid annuluses, as already noted, are maintained by liquid fed through bleed orifice 36 which liquid passes by loosely fitted floating piston 34. The strong pressure pulses developed in the liquid annuluses by virtue of the sonic vibration of the pistons generate high shock pressure in the confined liquid bodies. These pressure pulses are applied to the wall of the bore hole through perforations 11. Floating weighted piston 34 adds momentum to the vibrational wave action of the pressure pulses between pistons 30 and 32. This piston 34 also forces downwardly by gravity against liquid column 33*a* to aid in the strength of the pressure pulses above piston 32. Further pressure surge augmentation is implemented by means of the liquid film wedging effect of curved ski-nose-shaped top portions of piston 32 and bottom portion of piston 30, each forward motion of the ski-nose shape generating oil film pressure against casing 10. The confined annular liquid bodies 33*a* and 33*b* are impacted back and forth by the vibrating pistons, developing high surge and shock pressure in these liquid bodies.

It is to be noted that piston 34 is not essential to the operation of the invention and can be dispensed with in certain instances. Also, there may be certain situations where upper piston 30 may be dispensed with and piston 32 operated solely in conjunction with piston 34, the finite leakage flow rate through perforations 11 limiting the upward excursions of piston 34.

While the invention has been described and illustrated in detail, it is to be clearly understood that this is intended by way of illustration and example only and is not to be taken by way of limitation, the spirit and scope of the invention being limited only by the terms of the following claims.

I claim:

1. In an oil well having a casing installed in an oil bearing bore hole, a tubing string installed in said casing, check valve means installed in said string and means for providing sonic energy to said string in a longitudinal vibration mode whereby the check valve means is vibrationally actuated by the sonic energy to pump oil up said string, the improvement being means for coupling sonic energy to the wall of said bore hole to stimulate the release of oil therefrom comprising a plurality of annular piston means mounted along said string and the casing, at least one of said piston means being tightly fitted on said string, the outer walls of said piston means being closely spaced to the inner wall of the casing to provide dynamic liquid seals to the pumping action at the frequency of the sonic energy, means for feeding liquid to the annular space between the piston means such that a liquid annulus is formed between successive piston means, and perforations formed in the walls of said casing, sonic energy being transferred from the tubing string to the piston means, the sonic energy causing the liquid annuluses to be impacted between the piston means with hydraulic pressure pulses being developed in the liquid which pulses are applied through the casing perforations to the bore hole to stimulate the release of oil therefrom.

2. In an oil well having a casing installed in an oil bearing bore hole, a tubing string installed in said casing, check valve means installed in said string and means for providing sonic energy to said string in a longitudinal vibration mode whereby the check valve means is vibrationally actuated by the sonic energy to pump oil up said string, the improvement being means for coupling sonic energy to the wall of said bore hole to stimulate the release of oil therefrom, comprising a plurality of annular piston means mounted along said string and the casing, at least one of said piston means being tightly fitted on said string, the outer walls of said piston means being closely spaced to the inner wall of the casing, means for feeding liquid to the annular space between the piston means such that a liquid annulus is formed between successive piston means, a second of said piston means being loosely fitted on said string and located above said one of said tightly fitted piston means, said second of said piston means floating on the pressure of one of said liquid annuluses, and perforations formed in the walls of said casing, sonic energy being transferred from the tubing string to the piston means, the sonic energy causing the liquid annuluses to be impacted between the piston means with hydraulic pressure pulses being developed in the liquid which pulses are applied through the casing perforations to the bore hole to stimulate the release of oil therefrom.

3. The apparatus of claim 2 and further including weighting means in said second of said piston means to increase the inertia thereof.

4. The apparatus of claim 3 wherein the second of said piston means is fabricated of a resilient material, said weighting means comprising pellets embedded in said resilient material.

5. The apparatus of claim 2 wherein a third of said piston means is tightly attached to said tubing string above said second of said piston means.

6. The apparatus of claims 2 or 5 and further including orifice means formed in the tubing string for feeding liquid to the spaces between the tubing string and the casing so as to maintain the liquid annuluses.

7. A method for coupling sonic energy to the wall of an oil well bore hole to stimulate the release of oil therefrom, said bore hole having a perforated casing installed therein and a tubing string installed in the casing comprising the steps of placing a plurality of annular piston members on said tubing string in longitudinal spaced relationship, at least one of said piston members being tightly fitted to said string, the outer walls of said piston members being closely spaced to the casing to provide dynamic liquid seals to pumping action at the frequency of the sonic energy, feeding liquid to the annular spaces between said piston members to maintain liquid annuluses in said spaces, and feeding sonic energy to said tubing string in a longitudinal vibration mode such that the sonic energy is transferred to said pistons and effects impacting of said liquid annuluses so as to develop hydraulic pressure pulses therein, said pulses passing through the perforations in the casing and against the bore hole wall to stimulate the release of oil therefrom.

8. A method for coupling sonic energy to the wall of an oil well bore hole to stimulate the release of oil therefrom, said bore hole having a perforated casing installed therein and a tubing string installed in the casing comprising the steps of placing a plurality of annular piston members on said tubing string in longitudinal spaced relationship, at least one of said piston members being tightly fitted to said string, the outer walls of said piston members being closely spaced to the casing, feeding liquid to the annular spaces between said piston members to maintain liquid annuluses in said spaces, a second of the piston members being mounted above said one of said piston members and being loosely fitted on said string so as to float on the liquid pressure effect, and feeding sonic energy to said tubing string in a longitudinal vibration mode such that the sonic energy is transferred to said pistons and effects impacting of said liquid annuluses so as to develop hydraulic pressure pulses therein, said pulses passing through the perforations in the casing and against the bore hole wall to stimulate the release of oil therefrom.

* * * * *